United States Patent [19]

McFarlane

[11] Patent Number: 4,865,089

[45] Date of Patent: Sep. 12, 1989

[54] APPARATUS AND METHOD FOR VOLUMETRICALLY METERING A FOOD CHUNK/LIQUID MIXTURE IN A PREDETERMINED RATIO OF FOOD CHUNKS TO LIQUID

[75] Inventor: Donald P. McFarlane, Pavilion, N.Y.

[73] Assignee: Graham Corporation, Batavia, N.Y.

[21] Appl. No.: 84,516

[22] Filed: Aug. 10, 1987

[51] Int. Cl.[4] ..... B65B 3/04; B65B 3/30

[52] U.S. Cl. ..... 141/9; 141/83; 141/95; 141/104; 141/106; 141/198; 141/284; 141/365; 222/57; 99/342

[58] Field of Search ..... 141/83, 104, 105, 234, 141/235, 248, 266, 267, 268, 86, 94, 95, 106, 198, 9, 153, 170, 365, 284; 53/239, 155; 426/402, 232; 366/43, 189, 152, 153; 193/7, 25 E, 31 R; 222/56, 57, 64, 65, 145, 108; 210/514, 513, 768; 99/493, 342, 497, 499

[56] References Cited

U.S. PATENT DOCUMENTS

| | | | |
|---|---|---|---|
| 1,527,406 | 2/1925 | Hansen | 141/105 |
| 1,666,931 | 4/1928 | Hansen | 141/105 |
| 2,143,782 | 1/1939 | Lewy | 210/538 |
| 2,187,488 | 1/1940 | Brueggeman | 99/499 |
| 3,041,049 | 6/1962 | Tarukawa | 222/65 |
| 3,080,033 | 3/1963 | Scott et al. | 193/31 A |
| 3,692,072 | 9/1972 | Kohls | 141/391 |
| 3,694,996 | 10/1972 | Carlsen | 141/198 |
| 3,822,032 | 7/1974 | Vergobbi | 141/83 |
| 4,574,849 | 3/1986 | Fukuda | 141/83 |
| 4,592,397 | 6/1986 | Mitzner | 141/94 |

*Primary Examiner*—Henry J. Recla
*Assistant Examiner*—Edward C. Donovan
*Attorney, Agent, or Firm*—Cumpston & Shaw

[57] ABSTRACT

An apparatus and method are disclosed for dispensing a predetermined volume of a food chunk/liquid mixture having a predetermined ratio of food chunks to liquid without damaging the food chunks. The apparatus comprises at least one hopper, and a chute for receiving and selectively directing food chunks of the food chunk/liquid mixture into a cushion of liquid in the hopper. The metering apparatus preferably has sensing means for controlling the level of food chunks in the hopper, and a sensing means for selectively controlling the level of liquid in the hopper. When a constant predetermined volume of a food chunk/liquid mixture having a constant predetermined ratio of food chunks to liquid is consistently obtained in the hopper, a flap valve at the bottom of the hopper is repetitively opened for successively dispensing the food chunk/liquid mixture from the hopper into any suitable container.

30 Claims, 11 Drawing Sheets

APPARATUS AND METHOD FOR VOLUMETRICALLY METERING A FOOD CHUNK/LIQUID MIXTURE IN A PREDETERMINED RATIO OF FOOD CHUNKS TO LIQUID

FIELD OF THE INVENTION

The present invention relates generally to a food product metering apparatus, and more specifically to a metering apparatus for consistently dispensing a constant predetermined volume of a food chunk/liquid mixture having a constant predetermined ratio of food chunks to liquid without damaging the food chunks.

BACKGROUND OF THE INVENTION

The canning of food product comprising food chunks of fruit, vegetables or the like, such as peaches, pineapple, or potatoes immersed in any suitable compatible liquid, such as fruit juice, vegetable juice or water, is well known in the art.

An unsophisticated manual technique known in the industry for canning such food product involves placing an empty can in a vertical position, and then manually filling the can with food chunks to a visually observed level. Another manual canning technique involves placing an empty can in a slightly inclined position, and then manually filling the can with food chunks to a level where the food chunks begin to fall out of the can. Each can filled with food chunks by either of the aforementioned techniques is then retained or moved into a vertical orientation and tapped on a horizontal support to settle the food chunks. A liquid is then introduced into the cans to a visually observed level. The cans are sealed and then subjected to a sterilization operation.

A serious problem presented with either manual canning technique is that it is impossible to consistently fill the cans with the same volume of food product containing food chunks and liquid, and hence to consistently obtain a constant volume of food product per can having a constant ratio of food chunks to liquid. Accordingly, what is achieved by the manual canning techniques is minimal control of the volume of food product per can or of the ratio of food chunks to liquid per can. The problem is compounded with the use of flexible containers, such as bags, rather than cans, since the aforementioned manual canning techniques are not applicable to flexible containers and hence not even a minimal control of the volume of food product per flexible container or ratio of food chunks to liquid per flexible container is achievable.

In U.S. patent application Ser. No. 837,512, filed Mar. 7, 1986, and now abandoned, by the assignee of the present invention, apparatus is disclosed for dispensing to a container filling machine a supposedly predetermined volume of a solid food chunks/liquid mixture presumably having a predetermined ratio of food chunks to liquid. In the previously disclosed apparatus, food chunks at a desired sterilization temperature exit the separator through a valve at a non-uniform rate, and are joined with a supposedly predetermined volume of liquid discharged from a catch basin of the separator. The volume of discharged liquid is controlled by a valve which can be set to obtain a supposedly desired volumetric ratio of food chunks to liquid, such as 3:1, for example. One of the problems with this metering apparatus is that the food chunks and liquid each flow at a non-uniform rate, and hence it is impossible with this apparatus to dispense a repetitive, precise, consistent volume of food chunk/liquid mixture having a constant predetermined ratio of food chunks to liquid.

Therefore, an object of the present invention is to provide a metering apparatus for repetitively dispensing a constant predetermined volume of a food chunk/liquid mixture having a constant predetermined ratio of food chunks to liquid. The food product is dispensed without damaging the food chunks.

SUMMARY OF THE INVENTION

It is an object of this invention to provide a metering apparatus for consistently dispensing a constant predetermined volume of a food chunk/liquid mixture having a constant predetermined ratio of food chunks to liquid without damaging the food chunks comprising:

a hopper having an outlet movable between a normally closed position and an open position;

means responsive to movement of the outlet to its closed position for introducing liquid into the closed hopper to form a cushion of liquid;

means for receiving and feeding food chunks of a food product into the cushion of liquid in the hopper which prevents damage to the food chunks;

means for selectively controlling the level of food chunks in the hopper to a first predetermined level;

means for selectively controlling the level of liquid in the hopper to a second predetermined level to consistently obtain therein, when the food chunks reach the first level, a constant predetermined volume of a food chunk/liquid mixture in the hopper having a constant predetermined ratio of food chunks to liquid; and means for moving the closed outlet of the hopper to its open position for dispensing the predetermined volume of food chunks/liquid mixture from the hopper.

Yet a further object of the present invention is to provide a method of consistently dispensing a constant predetermined volume of a food chunk/liquid mixture having a constant predetermined ratio of food chunks to liquid, comprising the steps of:

providing a hopper having an outlet movable between a normally closed position and an open position;

introducing liquid into the closed hopper to form a cushion of liquid;

receiving and feeding food chunks into the cushion in the hopper which prevents damage to the food chunks;

filling the hopper with the food chunks to a first predetermined sensed level;

filling the hopper with liquid to a second predetermined sensed level to obtain therein, when the food chunks reach the first level, a predetermined volume of a food chunk/liquid mixture having a constant predetermined ratio of food chunks to liquid; and moving the outlet of the hopper to its open position to dispense the constant predetermined volume of food chunk/liquid mixture from the hopper.

In a further aspect of the invention, a pair of the hoppers are arranged in parallel, side-by-side relation, and means are provided for selectively alternately directing food chunks and any liquid remaining thereon into the hoppers.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Referring now to FIGS. 1–4 of the drawings, a preferred embodiment of the metering apparatus of this invention is shown incorporated in a food product separator 12. While the invention will be described in connection with apparatus for processing food products, it may also be used for non-food mixtures of solid chunks of material, especially delicate chunks, and liquids. The food product being separated comprises, for example, cooked or uncooked food chunks of fruit, vegetables or the like, such as peaches, pineapple or potatoes, immersed in any suitable compatible liquid, such as, for example, fruit juice, vegetable juice or water. The food product is fed into a hollow separator 12 through an inlet 11 at the upper end of the separator and along a wire chute 14 which partially separates the food chunks, liquid and gas from the food product. The wire chute 14 guides the food chunks and any liquid remaining on the food chunks into metering apparatus 10 enclosed within separator 12.

Figure 1:
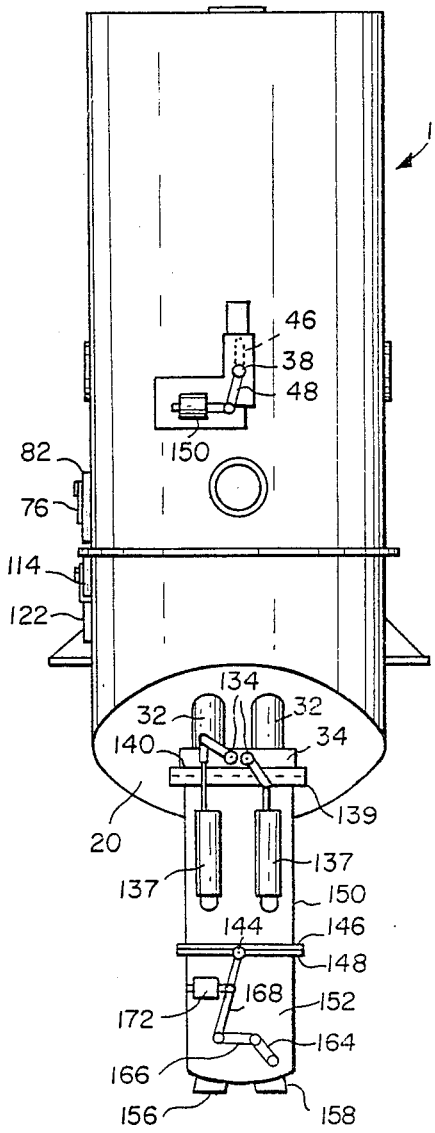
FIG. 1 is a front elevational view of a food product separator in which a preferred embodiment of the metering apparatus of this invention is incorporated.
Figure 2:
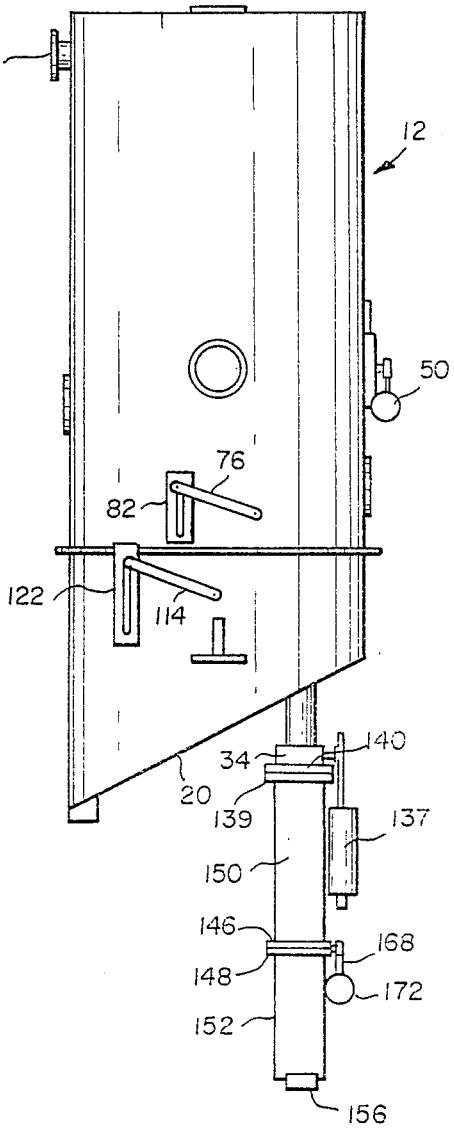
FIG. 2 is a side elevational view of the separator of FIG. 1.
Figure 3:
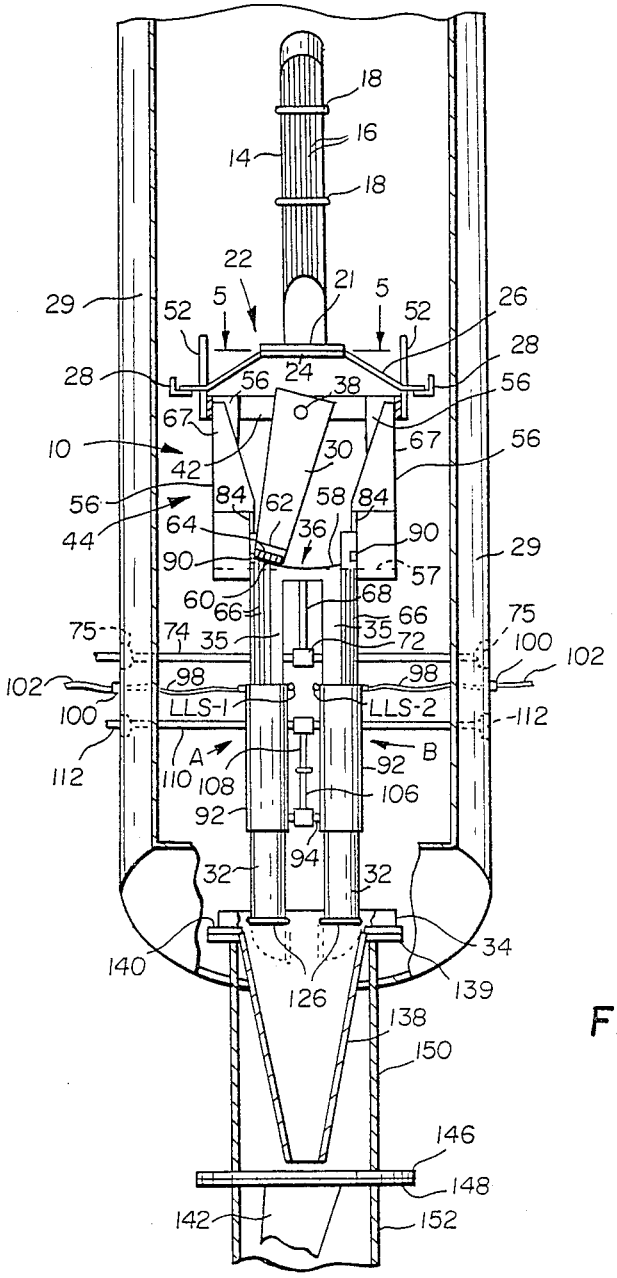
FIG. 3 is a front elevational view similar to FIG. 1 with a portion of the separator broken away to show a front elevational view of the metering apparatus.

The wire chute 14, as best seen in FIG. 3, comprises a plurality of parallel, spaced-apart wires 16 held in a circular configuration by spaced rings 18 secured to outer surfaces of the wires. The liquid and gas pass through the spaced wires with the liquid collecting in a catch basin 20 at the lower end of the separator, and the gas escaping through any suitable vent, not shown.

Figure 4:
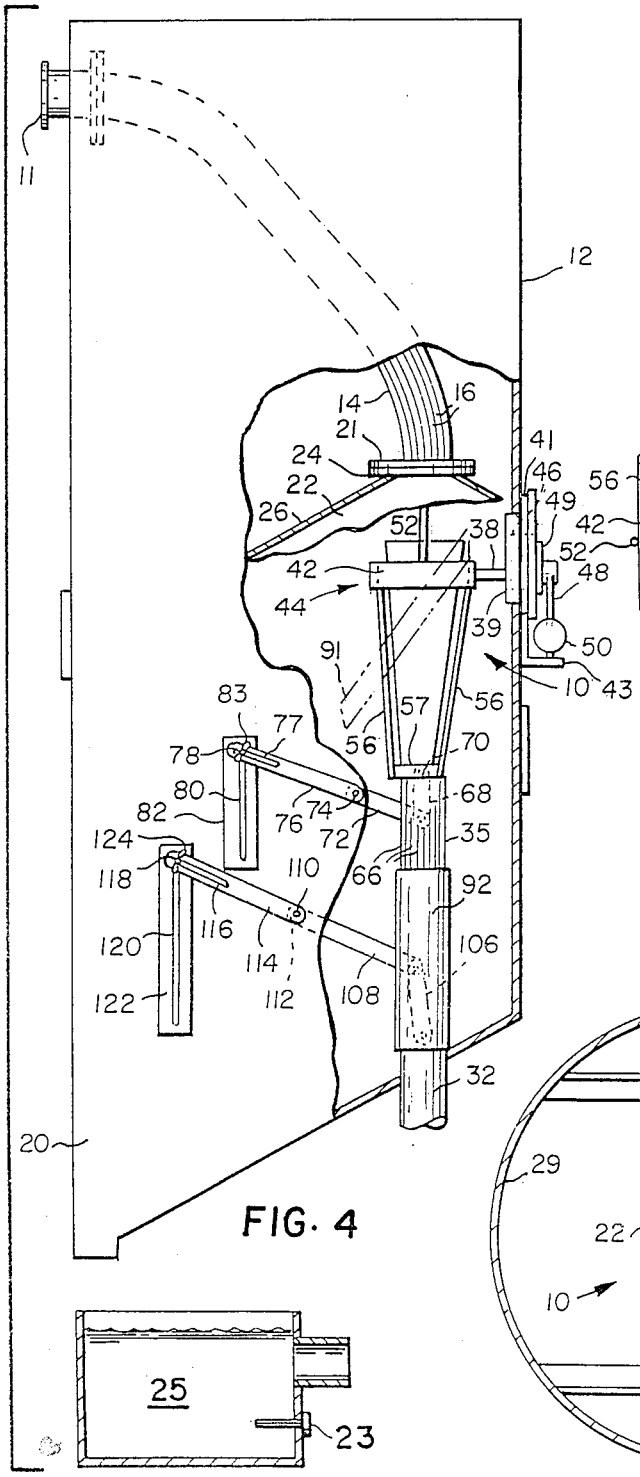
FIG. 4 is a view similar to FIG. 3 showing a side elevational view of the metering apparatus of FIG. 3.
Figure 5:
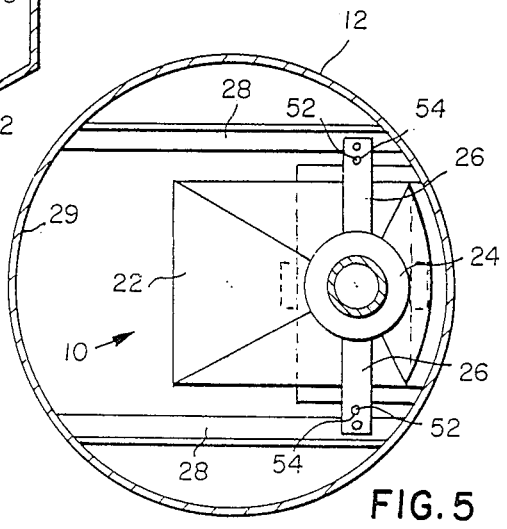
FIG. 5 is a top plan view taken substantially along line 5—5 of FIG. 3.

With reference to FIGS. 3, 4 and 5, a collar 21 at the outlet of wire chute 14 is secured to a collar 24 of a splash shield 22 which directs any falling liquid away from metering apparatus 10 and into catch basin 20. The splash shield collar 24 is mounted by metal straps 26 to a pair of angle irons 28 having ends thereof secured to separator wall 29 by welding or the like.

The metering apparatus 10 for consistently and repetitively dispensing a constant predetermined volume of food chunks/liquid mixture having a constant predetermined ratio of food chunks to liquid will now be described. The metering apparatus 10 comprises a pivotally mounted cone or funnel-shaped alternating chute 30 for receiving the food chunks exiting wire chute 14 by gravity. The alternating chute 30 is pivotally movable between two positions, as best seen in FIG. 3, for feeding the food chunks into one of two parallel hoppers designated A and B, each comprising a vertically arranged cylindrical hopper tube 32 attached at the lower end thereof to a valve body 34 (see FIGS. 1 and 3). Hoppers A and B each further comprise an upper vertically arranged depending hopper leg 35 of an inverted U-shaped spacer member 36, (FIG. 9) to be explained in greater detail hereinafter.

Figure 6:
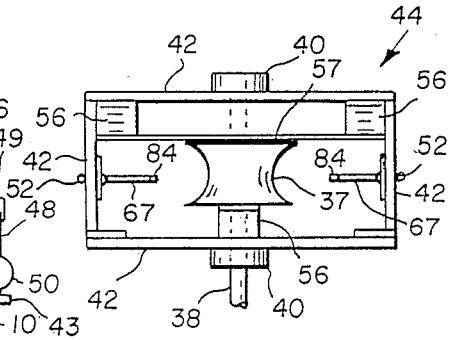
FIG. 6 is a top plan view of the frame member to which the alternating chute is mounted with the chute omitted for purposes of clarity.
Figure 7:
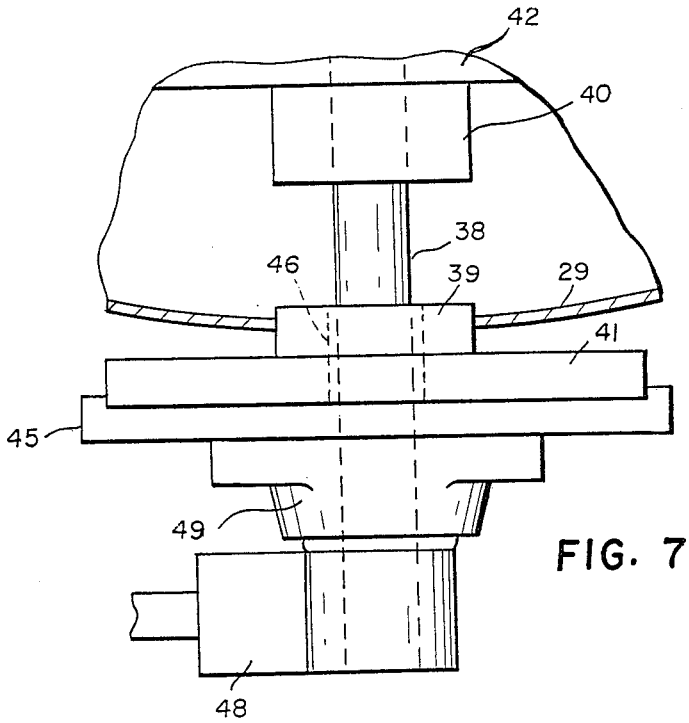
FIG. 7 is a top plan view of the shaft mechanism for actuating the alternating chute for pivotal movement.
Figure 8:
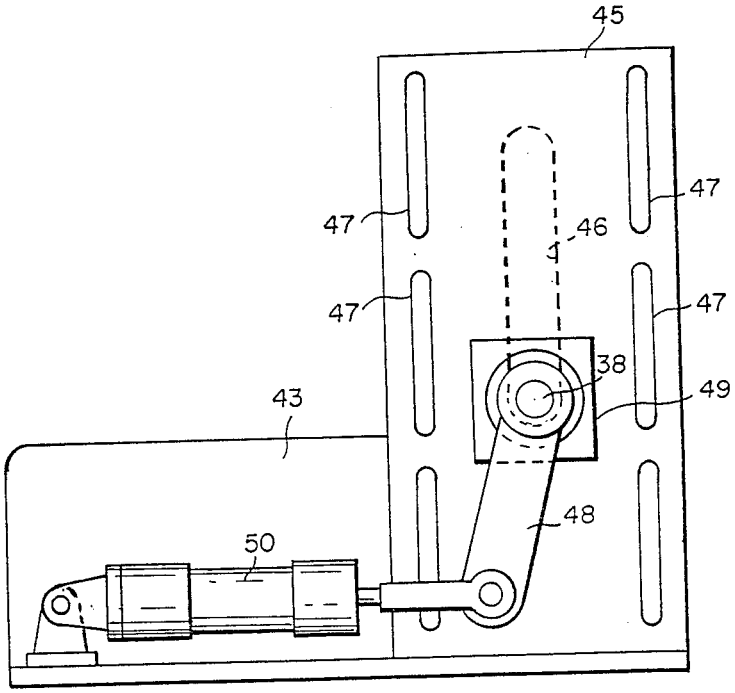
FIG. 8 is a front elevational view of the mechanism for pivotally moving the alternating chute.

The upper end of alternating chute 30 is secured to a shaft 38 which is rotatably mounted in bearings 40 supported by horizontal bars 42. The bars 42 form the rectangular upper end of a frame member 44, as best shown in FIGS. 4 and 6. One end of shaft 38 extends through an elongated opening 46 extending through a plate 41 having a rectangular projection 39 extending through an opening in wall 29 of separator 12 and secured thereto by welding or the like, as best seen in FIGS. 3, 7 and 8. Shaft 38 is secured to an actuator arm 48 which is pivotally movable in bearing 49 along with shaft 38 and chute 30 between hopper positions A and B by an air cylinder 50. Cylinder 50 is mounted on a bracket 43 having a plate 45 which is slidably mounted on plate 41 by virtu of bolts, not shown, extending through elongated slots 47 into threaded bores in plate 41, not shown. Any suitable seals, not shown, may encircle slot 46 and shaft 38. The elongated opening 46 and slots 47 allow vertical movement of frame member 44, shaft 38 and chute 30, as a unit, relative to separator 12 for changing the heights of hoppers A and B for varying the volume of food chunks contained therein, as will be explained in greater detail hereinafter. The horizontal bars 42 of frame member 44 have upwardly extending fingers 52 which are slidably movable into openings 54 adjacent the ends of straps 26, as best seen in FIGS. 3 and 5, for guiding frame member 44 for vertical movement.

The rectangular horizontal bars 42 further have a plurality of angled bars 56 depending therefrom (see FIGS. 3 and 6) which are connected to a horizontal crossbar 57. The crossbar is secured to an upper end 37 of inverted, U-shaped spacer member 36 of hoppers A and B, as best seen in enlarged form in FIGS. 9 and 10. The spacer member 36, crossbar 57, bars 42, 56 and chute 30 are all supported as a unit by a height adjusting means for hoppers A and B, to be explained hereinafter.

The depending hopper legs 35 of spacer member 36 are of semi-cylindrical shape having lower ends thereof slidably movable within semi-cylindrical upper end sections of hopper tubes 32 to form adjustable upper ends of hoppers A and B. The hopper legs 35 have semi-cylindrical curved upper open ends 58 thereof mating with the curved discharge end 60 of alternating chute 30. The chute discharge end and the upper open ends have the same center of curvature.

The chute discharge end 60 further has a collar 62 (FIG. 3) secured thereto provided with depending flexible fingers 64 to partially seal the chute discharge end to hopper legs 35 for guiding the food chunks therein when the cute discharge end 60 is in alignment therewith. The soft flexible fingers 64 prevent excessive damage to the food chunks during chute movement, and also accommodate any manufacturing discrepancies between the mating surfaces of hopper legs 35 and chute discharge end 60.

Figure 10:
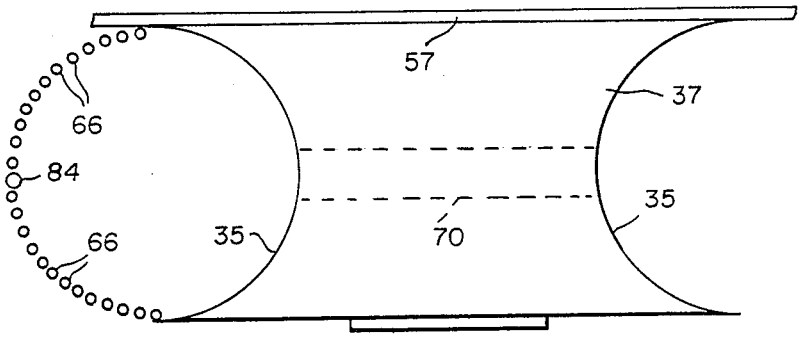
FIG. 10 is a top plan view of the hopper space member of FIG. 9.
Figure 9:
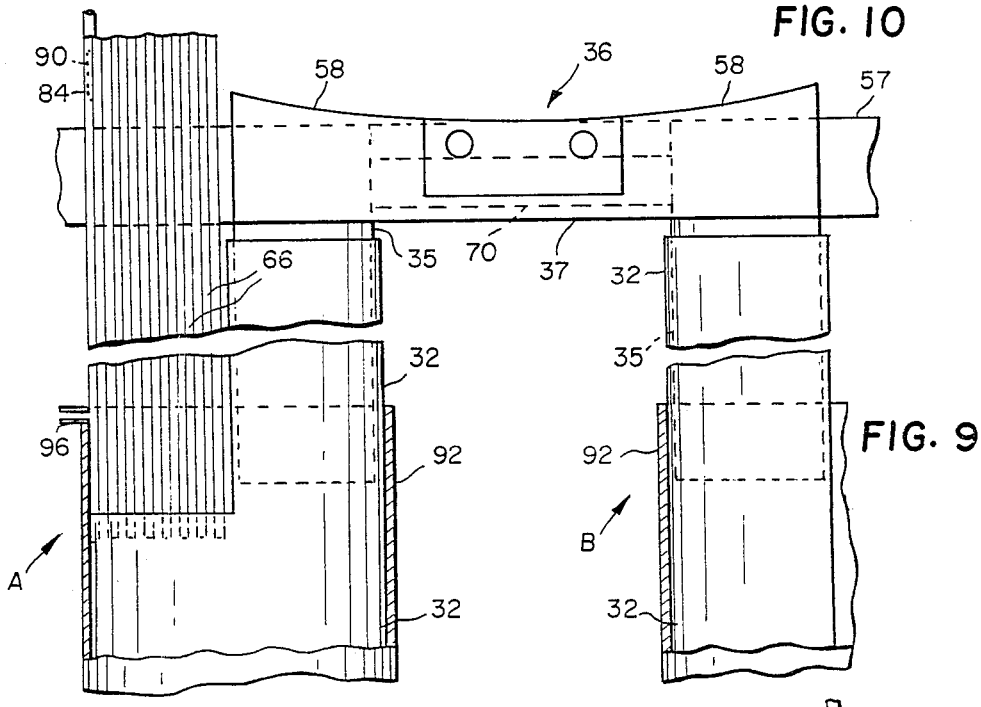
FIG. 9 is a front elevational view of the adjustable hopper spacer member for varying the level of the food chunks with portions of the hopper tubes, sleeves, fixed wires and movable food chunk sensor rod shown in part.

Secured to the inside of the fixed first and second hopper tubes 32 in facing relation to the semi-cylindrical upper end sections thereof are a plurality of vertically arranged, parallel, spaced-apart wires 66. The wires mate with the upper end sections and vertically movable hopper legs 35, shown only on hopper A in FIGS. 9 and 10, to form cylindrical portions of the upper ends of hoppers A and B, as best seen in FIGS. 3, 9 and 10, for retaining food chunks, but allowing liquid to pass therethrough into catch basin 20.

Figure 11:
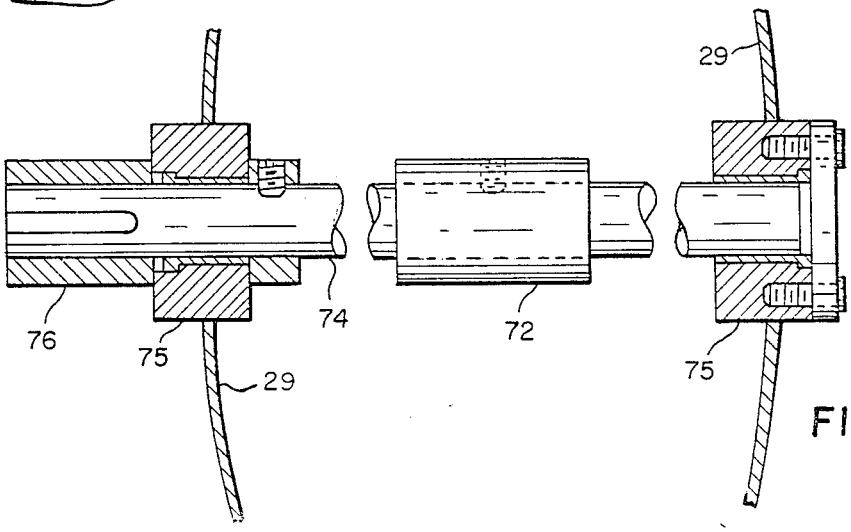
FIG. 11 is a top plan view of the shaft mechanism forming the pivot for the mechanisms for adjusting the level of food chunks and liquid in the hoppers.
Figure 12:
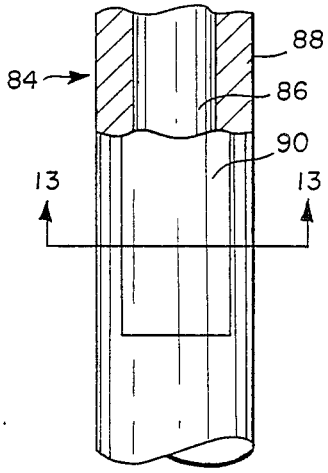
FIG. 12 is a segmental side elevational view, partly in section, of a food chunks level sensing electrode.
Figure 13:
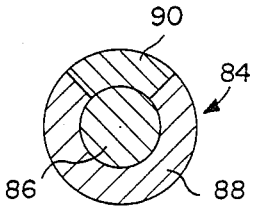
FIG. 13 is a section view taken substantially along line 13—13 of FIG. 12.
Figure 15:
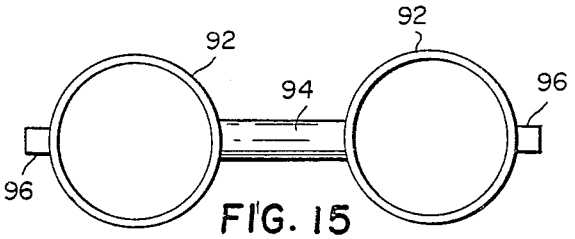
FIG. 15 is a top plan view of the hopper sleeves of FIG. 14.

To adjust the vertical height of hoppers A and B, and hence the volume of food chunks held therein, a hoppers height adjusting means is provided for vertically moving frame member 44, as best seen in FIGS. 2, 3, 4, 9 and 11. One possible form of the adjusting means comprises a lever linkage having a lever 68 pivotally mounted at one end on a shaft 70 secured to upper end 37 of the spacer member 36, and its opposite end pivotally connected to one end of another lever 72. The opposite end of lever 72 is secured to a pivot shaft 74 rotatably supported by and extending through bearings 75 mounted in the walls 29 of separator 12 (FIGS. 3 and 11). The end of shaft 74 extending out of the separator is secured to one end of a lever 76, (FIG. 4) the opposite end of which has a slot 77 for receiving the stem 78 of a lock bolt, which extends through a vertical slot 80 in a guide member 82. One enlarged end of lock bolt 78 is slidable within guide member 82 and the opposite end thereof has a wing nut 83 threaded thereon for securing lever 76 to guide member 82 in a selected position. To adjust the spacer member 36 relative to tubes 32 so that the hoppers A and B will hold a predetermined volume of food chunks, the wing nut 83, bolt 78 and the bolts extending through slots 47 are loosened, lever 76 pivoted to a desired position and the wing nut and bolts are tightened. Movement of lever 76 to the desired position pivots levers 68 and 72, which in turn lower or raise spacer member 36, frame member 44 and alternating chute 30 as a unit relative to the fixed tubes 32 depending upon whether lever 76 is moved in a clockwise or counter clockwise direction respectively.

With reference to FIGS. 3, 6, 12 and 13, a sensor rod 84 is provided for each hopper A and B for sensing the level of food chunks in the hopper each time the hopper is filled, which level is indicative of a consistently constant volume of food chunks in the hopper for a predetermined setting. Since the sensor rods 84 are identical, only one will be described in detail. The sensor rod 84 is parallel to and between a pair of wires 66, and is secured to a fin 67 mounted on a horizontal bar 42 for vertical movement therewith. The rod 84 comprises a wire 86 enclosed within an insulating tube 88, and a portion of the tube is broken away facing the food chunks in the hopper for receiving a metallic element 90, which is welded to wire 86 to form a food chunks sensing element at the upper end of the spacer member (see FIGS. 3, 9, 12 and 13). Accordingly, when a hopper is filled with food chunks to the upper end thereof, the food chunks engage sensing element 90 for a sufficient time to complete an electrical circuit for actuating air cylinder 50 which pivots alternating chute 30 into alignment with the other hopper for directing food chunks therein.

In the event a malfunction occurs and chute 30 is not pivoted away from a filled hopper, a spillway 91, shown dotted in FIG. 4, is provided on chute 30 for directing any excess food chunks into catch basin 20 to prevent possible jamming of food chunks between chute 30 and fixed parts such as wires 66, for example.

Figure 16:
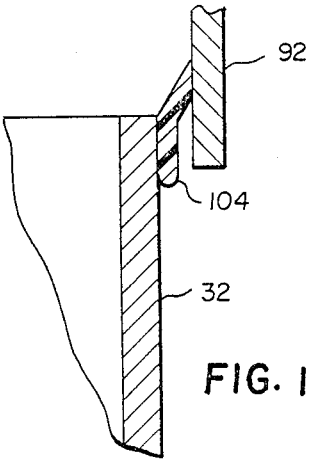
FIG. 16 is a segmental view in section showing the liquid seal between each hopper tube and hopper sleeve.

With reference to FIGS. 3, 4, 14 and 15, the mechanism for introducing liquid into hoppers A and B and for controlling the level of liquid in the hoppers will now be described. Since this mechanism is the same for each hopper, only one mechanism will be described in detail. The liquid control mechanism comprises sleeves 92, joined together by a short pivot shaft 94, and slidably mounted on tubes 32 of the hoppers with the upper ends thereof forming weirs to control the liquid level in the hoppers. Liquid is introduced into the hoppers through liquid inlets 96 at the upper ends of sleeves 92. Each inlet is connected by a flexible hose 98 (FIG. 3) to one end of a liquid conduit 100 extending through the wall 29 of separator 12. The opposite end of conduit 100 is connected by a tube or pipe 102 to any suitable pump, not shown, through a solenoid valve in liquid communication with a liquid supply, not shown. Upon actuation of the solenoid valves, liquid is introduced through sleeve inlets 96 and spaces between the vertical wires 66 into the hoppers A and B. A seal 104 between each sleeve 92 and hopper tube 32 (see FIG. 16) prevents any leakage of liquid out of the hopper. When a hopper is filled with liquid to the upper end of sleeve 92, continued introduction of liquid into the hopper causes the liquid to overflow the upper end of the sleeve forming a weir to control the level of the liquid to the height of the sleeve. Liquid level sensors LLS-1, LLS-2 are mounted at the upper end of the sleeves for sensing the liquid when it reaches the upper end of the sleeves and activating control relays CR-4, CR-7 for a purpose to be explained hereinafter.

Figure 14:
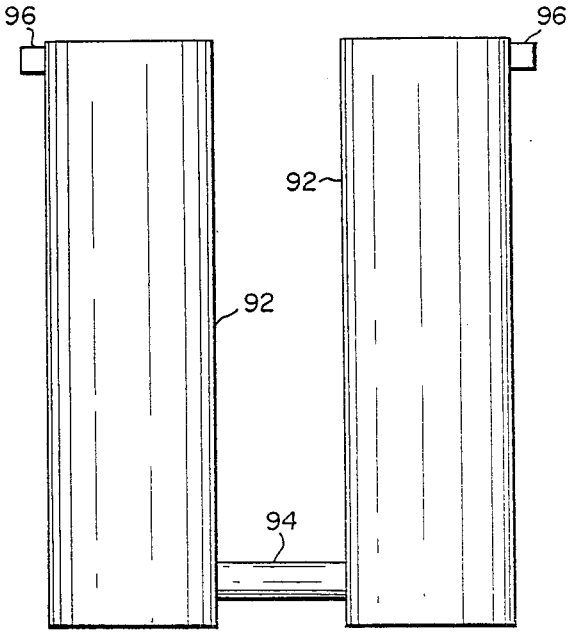
FIG. 14 is a front elevational view of the liquid level setting hopper sleeves.
Figure 17:
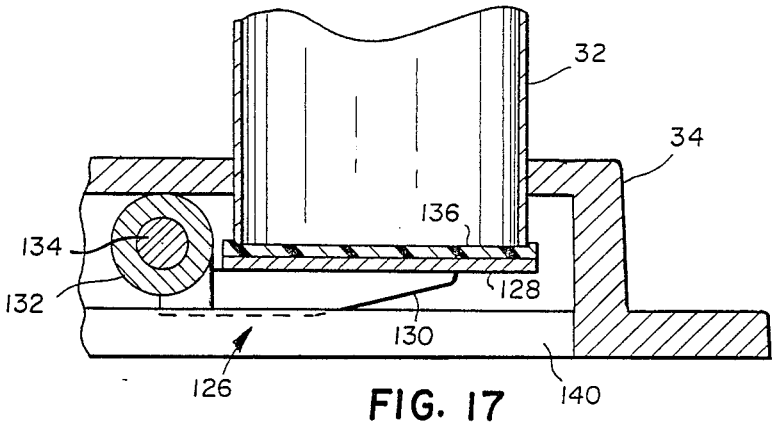
FIG. 17 is a front elevational view, partially in section, of a flap valve for closing and opening the outlet of a hopper tube.
Figure 18:
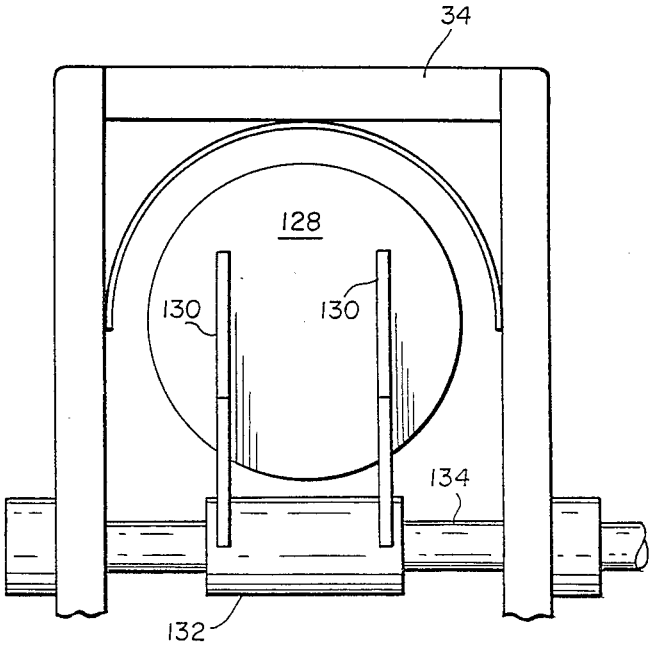
FIG. 18 is a bottom view of the flap valve of FIG. 17.

To vary the level of the liquid in the hoppers A and B for setting a predetermined ratio of food chunks to liquid, a liquid adjusting mechanism is provided for slidably moving sleeves 92 to a preselected position. One form of the liquid adjusting mechanism (FIGS. 3 and 4) comprises a pair of levers 106, 108 pivotally connected together at one of the ends thereof. The opposite end of lever 106 is pivotally mounted on shaft 94 (FIGS. 3 and 14). The opposite end of lever 108 is secured to a pivot shaft 110 journaled in bearings 112 in separator walls 29 identical to shaft 74 and bearings 75, shown in FIG. 11. The sleeves 92 and levers 106, 108 are movable by a lever 114 (FIG. 4) having one end secured to a portion of shaft 110 extending outside of separator 12. The opposite end of lever 114 has a slot 116 for receiving a stem 118 of a lock bolt. The enlarged end of the lock bolt is slidably mounted in a vertical slot 120 of a guide member 122 with the opposite threaded end of the bolt extending outwardly for receiving a wing nut 124. To adjust the upper end of the sleeves 92 to obtain a desired predetermined volume of liquid in hoppers A and B, wing nut 124 is loosened, lever 114 manually moved for pivotally moving levers 106, 108 and sliding sleeves 92 to a preselected position, and wing nut 124 tightened. ends of tubes 32 (FIG. 1) further pivotally supports a pair of flap valves 126, only one of which will be described in detail. Each flap valve 126, as best seen in FIGS. 17 and 18, comprises a circular plate 128 mounted on a pair of support ribs 130 which are in turn secured to a collar 132 keyed to a shaft 134. The plate 128, in its closed position, has a resilient surface 136 that sealingly engages the outer end face of tube 32. The flap valve 126 is normally closed, and is moved to its open position by an air cylinder 137 (FIGS. 1 and 2) triggered by an electrical circuit means in response to movement of alternating chute 30 from one hopper to the other and the losing of a liquid level sensor relay switch, to be explained in greater detail hereinafter.

Initially, the upper ends of hoppers A and B and the upper ends of sleeves 92 are properly adjusted by the adjusting mechanisms to obtain in a selected hopper, following introduction of food chunks and liquid, a consistently constant predetermined volume of a food chunk/liquid mixture having a constant predetermined ratio of food chunks to liquid. The hopper flap valve 126 is opened in response to movement of alternating chute 30 from the selected hopper to the other hopper and the closing of a liquid level sensor relay switch to dispense the food chunk/liquid mixture.

Figure 19:
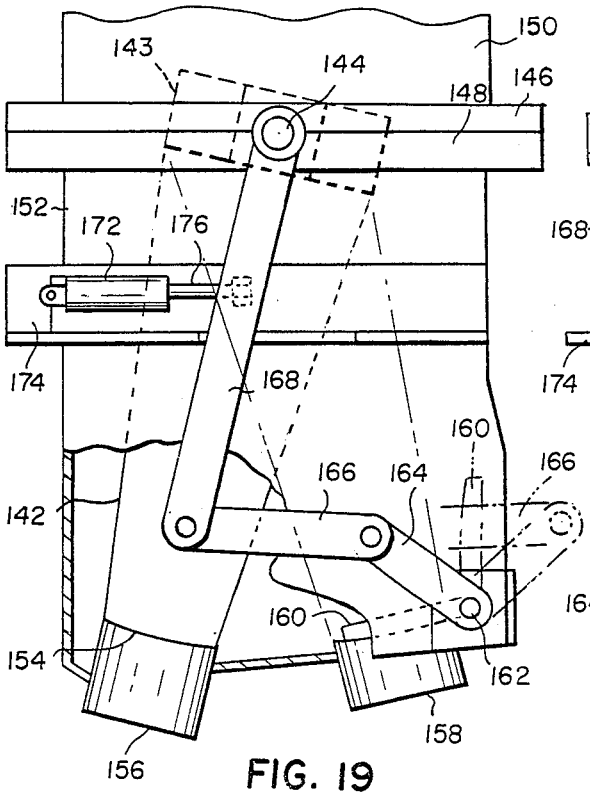
FIG. 19 is a front elevational view of a food product diverting mechanism, partially broken away for diverting food product of a temperature below or above a predetermined temperature or temperature range away from the food product filling means.
Figure 20:
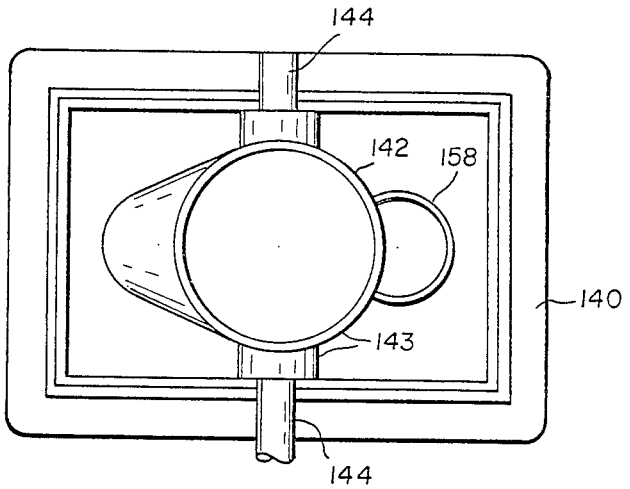
FIG. 20 is a top plan view of the diverting mechanism of FIG. 19.
Figure 22:
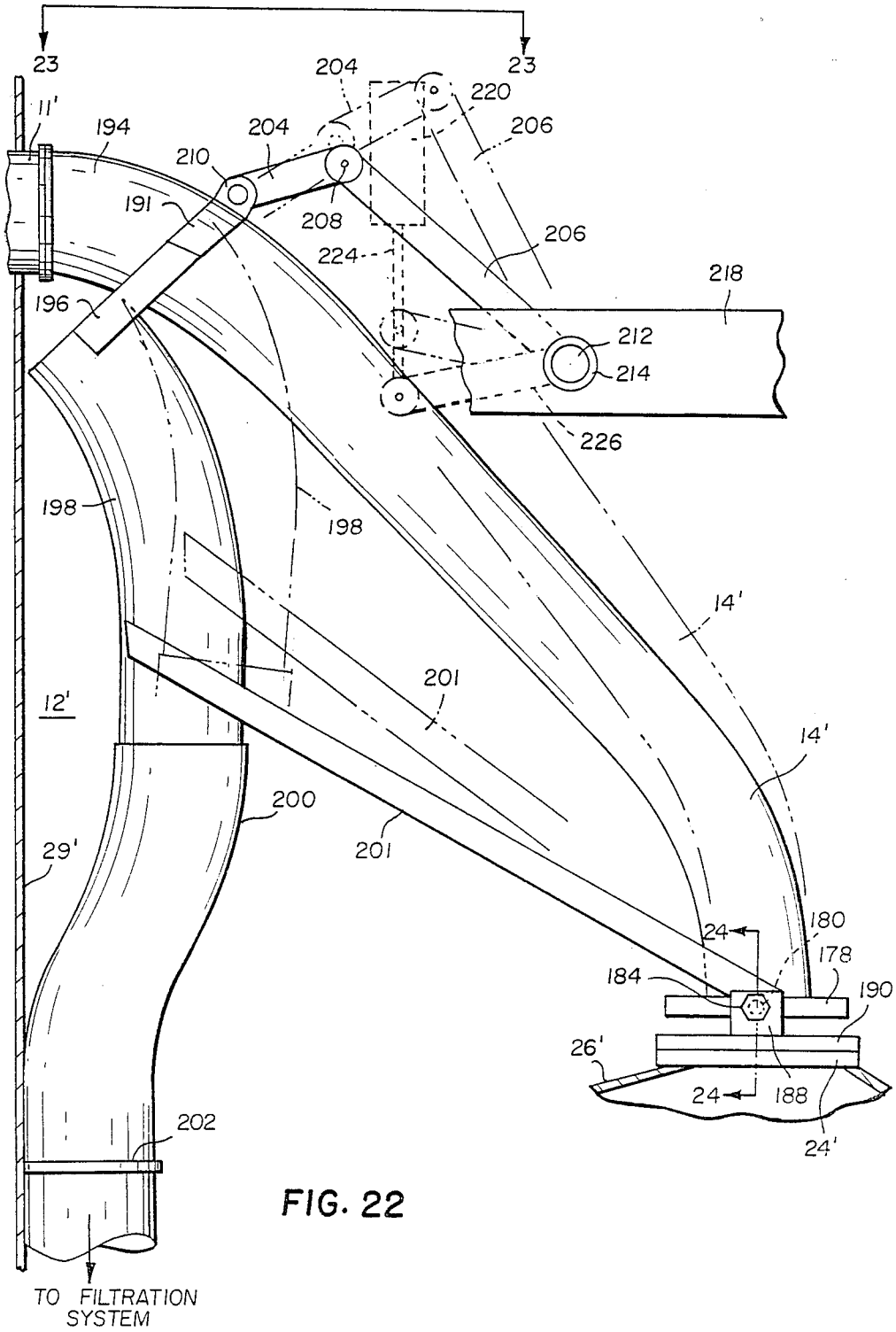
FIG. 22 is a segmental side elevational view of a food product separator showing another preferred embodiment of a food product diverting mechanism.

The mixture is dispensed into a frusto-conically shaped funnel 138 (see FIG. 3) located below flap valves 126. The funnel has a rim 139 secured to a flap valve housing 140 attached to the lower surface of valve body 34. The mixture is dispensed by gravity through the discharge end of funnel 138 into the inlet end of a pivotally mounted diverting chute 142 substantially identical to alternating chute 30. The upper end 143 of diverting chute 142, as best seen in FIGS. 19 and 20, has laterally extending stub shafts 144 integral therewith. The shafts 144 are journaled in mating recesses in abutting peripheral flanges 146, 148 of aligned housings 150, 152 respectively. The outlet end 154 of chute 142 may have a flexible finger collar similar to collar 62 that is alignable in one position, as seen in FIG. 19, with a filler tube 156 of any suitable container filling means. In another position, as seen dotted in FIG. 19, outlet end 154 is in alignment with a diverting tube 158 for diverting away from the filling means any food product mixture of a temperature below or above a predetermined temperature or temperature range.

Figure 21:
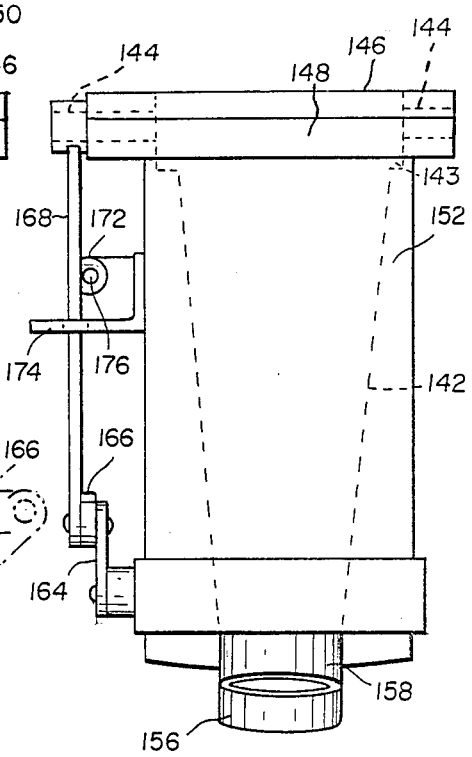
FIG. 21 is a side elevational view of the diverting mechanism of FIG. 19.

A closure is provided for closing and opening the open end of diverting tube 158. The closure comprises a cap 160 having a curved surface mating with the curved end surface of diverting tube 158. The cap 160 is mounted for pivotal movement about a fixed pivot 162. Pivotal movement is imparted to cap 160 by means of a linkage comprising a pair of pivotally connected levers 164, 166, one end of which is journaled on pivot 162 and secured to cap 160. The other end of the levers 164, 166 is pivotally mounted on the end of an arm 168 fixed to and depending from one of the stub shafts 144, as seen in FIGS. 19 and 21. Pivotal movement is imparted to diverting chute 142 by an air cylinder 172 having one end thereof pivotally mounted on a fixed flange 174, and a reciprocally movable rod 176 thereof secured to arm 168.

Figure 23:
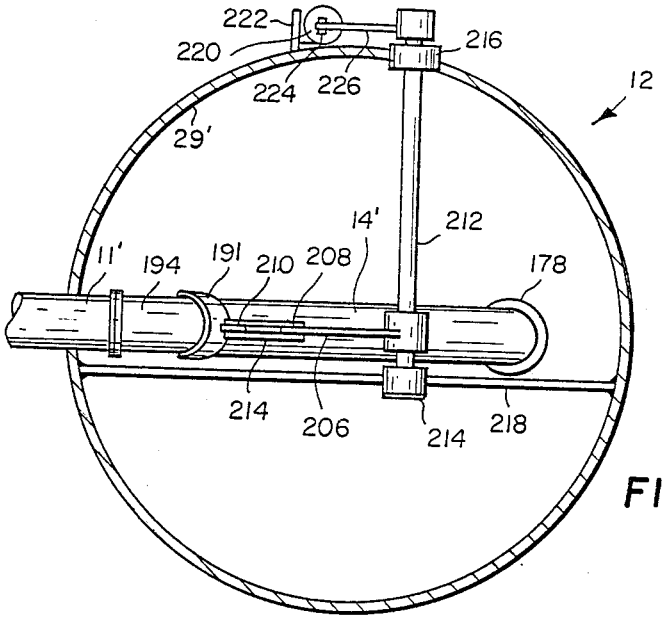
FIG. 23 is a top plan view taken substantially from line 23–23 of FIG. 22.
Figure 24:
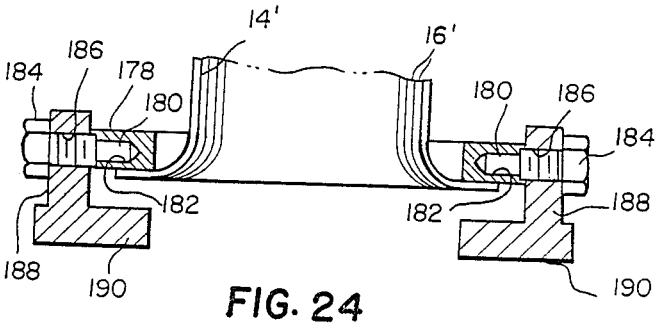
FIG. 24 is a section view taken substantially along line 24–24 of FIG. 22.
Figure 25:
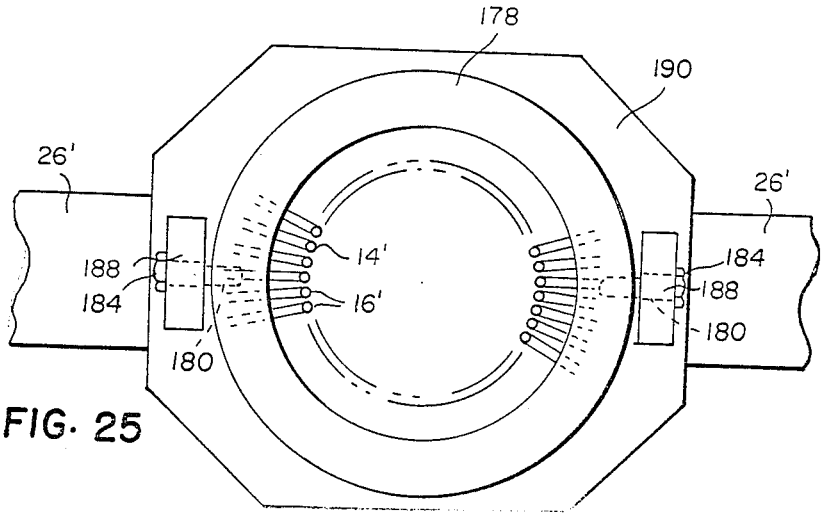
FIG. 25 is a top plan view of the wire chute outlet mounting of FIG. 24.

With reference to FIGS. 22–25, another preferred embodiment of the diverting means of the invention is disclosed for diverting food product mixture of a temperature below or above a predetermined temperature or temperature range away from the metering apparatus. In this diverting means, parts similar to aforementioned parts will be denoted by the same numerals primed. The diverting means (FIG. 22) comprises a wire chute 14' similar to aforementioned wire chute 14 having spaced-apart wires 16' secured to a ring 178 at the outlet end of the wire chute (FIG. 24). The ring 178 is pivotally mounted on stub shafts 180 journalled in diametrically opposed openings 182 in the ring. The stub shafts 180 are end portions of bolts 184 threaded through threaded openings 186 in upwardly extending flanges 188 of a collar 190 on splash shield 24'.

The inlet end of wire chute 14' has a ring 191 to which ends of wire 16' are secured. The inlet end of wire chute 14' is normally aligned with food product inlet pipes 11', 194 which are joined together and direct the food product into wire chute 14'. The ring 191 is secured by metal straps 196 to an end of a diverting tube 198, the opposite end of which is secured to the upper end of a flexible tube 200. A stiffening strap 201 couples the opposite end of diverting tube 198 to ring 178. The opposite end of flexible tube 200 is guided by bands 202 to separator wall 29' and discharges into the lower end of separator catch basin 20', which in turn discharges into a liquid filtration system, not shown, that separates fine solids from the liquid.

A food product temperature sensor, not shown, is preferably mounted in a pool of liquid collected immediately before the filtration system. If a temperature is sensed below a predetermined temperature or temperature range at which the food product is sterilized, or above a predetermined temperature or temperature range at which the food product may be damaged, the food product diverting means are actuated for pivotally moving wire chute 14' out of alignment with inlet pipe 194, and the open end of diverting tube 198 into alignment therewith. Accordingly, the food product that would normally enter the metering apparatus is diverted through diverter and flexible tubes 198, 200 respectively, out of separator 12' and into any suitable repository, such as a filtration system for removal of the liquid and possible return of the food chunks to the processing apparatus.

The food product diverting means comprises in addition to wire chute 14'and diverting tube 198, a pair of levers 204, 206 pivotally joined together at one of the ends thereof on a pivot 208. The opposite end of lever 204 is pivotally connected to an eyelet 210 on wire chute ring 191, and the opposite end of lever 206 is secured to a shaft 212. As best seen in FIG. 23, the shaft 212 is rotably mounted in a pair of bearings 214, 216, one of which is mounted in a cross-bar 218 in separator 12' and the other in separator wall 29'. The diverting means is moved between food product diverting and non-diverting positions by an air cylinder 220 mounted on a flange 222 secured to the outer surface of separator wall 29'. The cylinder 220 has a rod 224 pivotally secured to one end of a crank lever 226, the opposite end of which is secured to shaft 212. The cylinder 220 is normally in its non-diverting position, as seen in full lines in FIG. 22, in which wire chute 14' is aligned with inlet pipe 194. Upon actuation by the temperature sensor, cylinder 220 is moved into its diverting position, in which wire chute 14' is moved out of alignment with inlet pipe 194 and diverting tube 198 is moved into alignment therewith, as seen dotted in FIG. 22.

Figure 26:
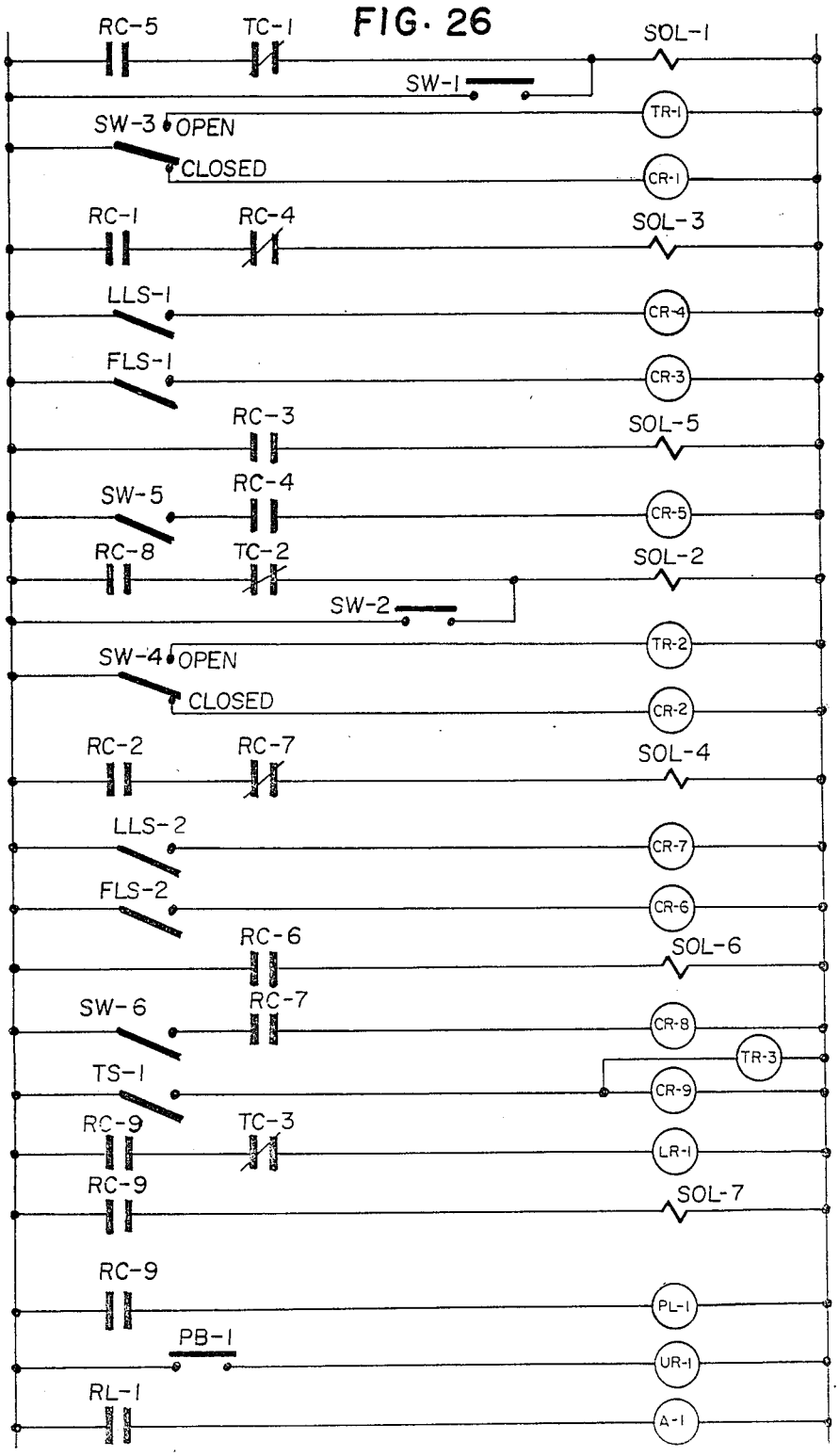
FIG. 26 is an electrical circuit ladder diagram for the metering apparatus of this invention.

The operation of the metering apparatus will now be described in relation to the electrical circuit ladder diagram illustrated in FIG. 26. Manual override switches SW-1, SW-2 are provided, adapted, when manually closed, to actuate flap valve cylinder solenoids SOL-1, SOL-2 for moving normally closed flap valve 126s to their open positions and retaining them in these positions indefinitely for cleaning and maintenance of the metering apparatus.

To initiate the metering operation, override switches SW-1, SW-2 are manually moved to their open positions. The solenoids SOL-1, SOL-2 are de-energized causing the flap valves to return to their closed positions closing flap valve limit switches SW-3, SW-4 which activate contact relays CR-1, CR-2, closing contacts RC-1, RC-2. This completes the electrical circuit to liquid control solenoids SOL-3 and SOL-4 connected to the solenoid valves in liquid supply lines 102 through normally closed relay contacts RC-4, RC-7 for introducing liquid into both of the closed hoppers A and B.

If the alternating chute 30 is positioned to direct food chunks into hopper A, the food chunk level sensor element 90 senses the food chunks when the hopper is filled. Sensor element 90 closes a sensor switch FLS-1 actuating control relay CR-3 for closing contact RC-3. This actuates alternating chute solenoid SOL-5 causing air cylinder 50 to move alternating chute 30 into alignment with hopper B for closing a chute limit switch SW-5 and directing food chunks into hopper B.

When the liquid introduced in hopper A is sensed by liquid level sensor LLS-1, control relay CR-4 is actuated closing normally open relay contact RC-4. This completes the electrical circuit through closed chute limit switch SW-5 to control relay CR-5 which is actuated closing relay contact RC-5. This electrically energizes flap valve solenoid SOL-1 through a normally closed, timed open contact TC-1 causing flap valve 126 on hopper A to open for dispensing a predetermined volume of a food chunks/liquid mixture having a predetermined ratio of food chunks to liquid. The normally closed and timed open contact TC-1 will hold flap valve 126 on hopper A open for a sufficient time, such as two seconds, for example, to allow the mixture to be completely emptied from the hopper. When flap valve 126 on hopper A closes, switch SW-3 is closed, control relay CR-1 is activated closing relay contact RC-1, and solenoid SOL-3 is energized causing the flow of liquid to hopper A to immediately commence.

As soon as the food chunks level sensor FLS-2 for hopper B of the apparatus is actuated upon filling of the hopper by the food chunks directed therein, contact relay CR-6 is actuated, closing relay contact RC-6 for electrically energizing alternating chute solenoid SOL-6, actuating alternating chute air cylinder 50 for moving the chute back into alignment with hopper A and closing chute limit switch SW-6. When the liquid previously being introduced into hopper B through the energization of solenoid SOL-4 reaches liquid level sensor LLS-2, control relay CR-7 is actuated closing normally open relay contact RC-7. This completes the electrical circuit through closed chute limit switch SW-6 to control relay CR-8 which is actuated closing relay contact RC-8. This electrically energizes flap valve solenoid SOL-2 through a normally closed, timed open contact TC-2 causing flap valve 126 on hopper B to open for dispensing a predetermined volume of a food chunks/-liquid mixture having a predetermined ratio of food chunks to liquid.

In this metering process, the liquid is introduced into hoppers A and B before the food chunks are introduced therein to form cushions of liquid. Accordingly, the food chunks alternatively directed into hoppers A and B strike the cushion of liquid in the partially filled hoppers which cushion the falling food chunks and prevent serious bruising or squashing of the food chunks which might occur if they were to land directly on a flap valve 126. The cyclical filling and dispensing of a constant predetermined volume of food chunks/liquid mixture having a consistently constant predetermined ratio of solid chunks to liquid will alternatively continue for filling one or more containers until the manual override switches are moved to their open positions.

With reference to FIGS. 19–22 and 26, in the event the temperature of the food product falls below a predetermined sterilization temperature or temperature range, or rises above the temperature range at which the food product may be damaged, the diverting means is activated to divert the food product away from the container filling station. To achieve this result, a temperature switch TS-1, which is responsive to a liquid temperature sensor preferably located in a pool of liquid collected immediately before passing through a filtration system, not shown, senses the temperature of the liquid. If the temperature falls below a safe sterilization temperature, or exceeds a damaging temperature, temperature switch TS-1 is closed, activating control relay CR-9 for closing three relay contacts RC-9. One relay contact RC-9 completes the circuit to solenoid SOL-7 which causes air cylinder 172 or 220 to move diverting chute 142 or 198 to its diverting position. Another relay contact CR-9 completes the circuit to a low/high temperature pilot light PL-1. The last relay contact CR-9 completes a circuit through a normally closed timed open contact TC-3 to an alarm latch relay LR-1. Contact TC-3 was initially timed open for substantially two seconds by timed relay TR-3 and then closed. Latch relay LR-1 closes relay contact RL-1 completing the electrical circuit to an alarm A-1. The alarm A-1 will continue sounding until it is acknowledged by the operator who must manually close switch PB-1. This activates unlatch relay circuit to alarm A-1. When the temperature of the liquid reaches the proper sterilization temperature, liquid temperature switch TS-1 automatically opens breaking the electrical circuit to control relay CR-9, which in turn opens relay contacts RC-9. This will cause diverting chute 142 or 198 to return to its normal position directing food product to the container filling station, and the pilot light to be turned off.

The invention has been described in detail with particular reference to a preferred embodiment thereof, but it will be understood that variations and modifications can be effected within the spirit and scope of the invention.

What is claimed is:

1. A metering apparatus for dispensing a predetermined volume of a chunk/liquid mixture having a constant ratio of chunks to liquid without damaging the chunks comprising:

a hopper having an outlet and means for moving said outlet between a normally closed position and an open position:

first means for introducing liquid into the hopper to form a cushion of liquid;

second means for receiving and directing chunks of a product into the cushion of liquid in the hopper which prevents damage to the chunks;

third means for selectively controlling the level of chunks in the hopper to a first predetermined level;

fourth means for selectively controlling the introduction of liquid such that the level of liquid in the hopper reaches a second predetermined level substantially below said first level to obtain therein, when the chunks reach the first level, a predetermined volume of a chunk/liquid mixture in the hopper having a constant volume of the ratio of chunks to liquid; and fifth means for moving the closed outlet of the hopper to its open position for dispensing the predetermined volume of chunk/liquid mixture from the hopper.

2. The invention according to claim 1 wherein the first means is responsive to movement of the outlet to its closed position.

3. The invention according to claim 2 wherein the first means is responsive to the means for selectively controlling the level of liquid and means for selectively

4. A metering apparatus for dispensing a predetermined volume of a chunk/liquid mixture having a consistently constant predetermined ratio of chunks to liquid comprising:

a plurality of hoppers, each having an outlet and means for moving said outlet between a normally closed position and an open position;

first means for introducing an initial volume of liquid into the hoppers to form cushions of liquid therein;

second means for receiving and selectively directing solid chunks of a product into the cushion of liquid in a selected one of the plurality of hoppers, which prevents damage to the chunks;

third means for sensing the level of chunks in said selected one hopper;

fourth means responsive to said chunk level sensing means for selectively controlling the level of chunks in the selected one hopper to a first predetermined level;

fifth means for sensing the level of liquid in said selected one hopper;

sixth means responsive to said liquid level sensing means for selectively controlling the introduction of liquid such that the level of liquid into the selected one hopper reaches a second predetermined consistently constant level, to obtain therein, after the chunks reach the first level, a predetermined volume of chunk/liquid mixture in the selected one hopper; and seventh means responsive to said sixth means for moving the closed outlet of the selected one hopper to its open position for dispensing the predetermined volume of chunk/liquid mixture from the selected one hopper when said predetermined volume of chunks to liquid mixture is reached.

5. The invention according to claim 4 wherein the means for introducing said initial column of liquid into the selected one hopper is responsive to said movement of the outlet to its closed position.

6. The invention according to claim 5 wherein the receiving and directing means comprises an alternating chute having one end into which a chunks/liquid mixture is introduced.

7. The invention according to claim 6 wherein the receiving and directing means comprises a frame, and the alternating chute is mounted on the one end thereof on a shaft in the frame for pivotal movement, and actuating means are coupled to the shaft for selectively moving the shaft and chute with the opposite end of the chute in alignment with an inlet in one of the hoppers.

8. The invention according to claim 7 wherein the metering apparatus is mounted in a vessel and the vessel has guide means for guiding the chunks of the chunk/liquid mixture into the one end of the chute.

9. The invention according to claim 8 wherein the guide means comprises a plurality of spaced elongated rods defining in cross section an endless rod configuration.

10. The invention according to claim 9 wherein the chute has an inclined spillway encircling the one end of the chute for directing chunks overflowing the one end into the vessel.

11. The invention according to claim 6 wherein the means for controlling the level of chunks comprises means for adjusting the vertical position of the chute, and a chunks level sensor coupled to and movable with the chute.

12. The invention according to claim 7 wherein the means for controlling the level of chunks comprises means for adjusting the vertical position of the frame, spacer means secured to the frame having one end in engagement with the opposite end of the chute when it is in alignment with one of the two hoppers, and a chunks level sensor coupled to and movable with the frame.

13. The invention according to claim 12, and further comprising a vessel in which the metering apparatus is enclosed, wherein the frame is secured to the inside of the vessel and wherein the frame adjusting means comprises a plurality of connected pivotal levers having one end coupled to the frame and the opposite end releasably movable to a selected position.

14. The invention according to claim 12 wherein the spacer means comprises a pair of semi-cylindrical tubes connected together in spaced parallel relation in which one of the ends thereof have arcuate surfaces defining a radius substantially equal to the radius of the opposite arcuate end surface of the chute, and the opposite ends of the tubes are slidably movable within the two hoppers.

15. The invention according to claim 14 wherein the opposite end of the second chute is provided with a ring of soft flexible extending fingers.

16. The invention according to claim 14 wherein semi-cylindrical portions of the upper ends of the hoppers are provided with upwardly extending parallel, spaced-apart, elongated wires.

17. The invention according to claim 16 wherein the means for controlling the level of liquid in the hoppers comprises sleeves slidably mounted on the hoppers in which the upper ends thereof cooperate with the spaced wires to form a liquid level controlling weir.

18. The invention according to claim 17 wherein the sleeves are secured together, and means are coupled to the sleeves for vertically adjusting the sleeves.

19. The invention according to claim 18, and further comprising a vessel in which the metering apparatus is enclosed, wherein the frame is secured to the inside of the vessel, wherein the frame adjusting means comprises a plurality of pivotal levers having one end coupled to the frame and the opposite end extending outside of the vessel and releasably movable to a selected position and wherein the sleeves adjusting means comprises a plurality of connected pivotal levers having one end connected to the sleeves and the opposite end releasably movable to a selected position.

20. The invention according to claim 19, and further comprising a container filling means, a chunk/liquid mixture recycling means, and a diverter means for receiving a predetermined volume of a chunk/liquid mixture dispensed from a selected hopper and directing the mixture to the container filling means if it is of a predetermined temperature, and diverting the mixture into the recycling means if it is of a temperature outside of the predetermined temperature.

21. The invention according to claim 20 wherein the diverter means comprises a second pivotally mounted chute having an open end for receiving the solid chunk-/liquid mixture, and its opposite end selectively movable into alignment with a first entry tube of the container filling means and second entry tube of the recycling means, a temperature sensor for sensing the temperature of the solid chunk/liquid mixture, and power means coupled to the second chute and responsive to the temperature sensor for moving the chute into alignment with one of the first and second entry tubes.

22. The invention according to claim 21 wherein the opposite end of the second chute and ends of the first and second entry tubes have mating arcuate surfaces of substantially the same radius.

23. The invention according to claim 22 wherein the opposite end of the second chute is provided with a ring of soft flexible fingers.

24. A method for dispensing a predetermined volume of a chunk/liquid mixture having a consistently constant predetermined ratio of chunks to liquid comprising the steps of:

providing a hopper having an outlet movable between an open position and a closed position;

closing the outlet of the hopper;

introducing liquid into the closed hopper to form a cushion of liquid;

receiving and directing chunks of a product into the cushion of liquid which prevents damage to the chunks;

filling the hopper with the chunks to a first level;

terminating the filling of chunks into the hopper when the chunks reach the first level;

continuing to fill the hopper with liquid to a second level; and moving the hopper outlet to its open position in response to the chunks reaching the first level and the liquid reaching the second level for a time sufficient to dispense the chunk/liquid mixture from the hopper.

25. A method according to claim 24 wherein the outlet of the hopper is moved into its open position for substantially two seconds.

26. A method according to claim 24 wherein the outlet of the hopper is normally in its closed position, and wherein the liquid is introduced into the hopper in response to movement of the hopper outlet to its closed position.

27. A method for dispensing a predetermined volume of a chunk/liquid mixture having a consistently constant predetermined ratio of chunks to liquid from a selected one of a pair of hoppers of a metering apparatus, the hoppers having outlets movable between normally closed and open positions, the metering apparatus further having means for introducing liquid into the hoppers, a pivotal chute for selectively directing chunks of a product into a selected one of the pairs of hoppers; a first sensor for sensing a selected level of chunks in the selected one hopper, chute moving means responsive to the first sensor for moving the chute to direct chunks into the other hopper, a second sensor for sensing a selected level of liquid in the selected one hopper to obtain therein a predetermined volume of a chunks/liquid mixture having a consistently constant predetermined volume of chunks to liquid, and hopper outlet moving means responsive to the first and second sensors for moving the outlet of the selected one hopper to its open position for dispensing the predetermined volume of solid food/liquid mixture from the selected one hopper, the method comprising the step of:

closing the outlets of the pair of hoppers;

introducing liquid into the pair of closed hoppers to form cushions of liquid therein;

directing chunks of product by the chute into the cushion of liquid in a selected one hopper of the pair of hoppers which prevents damage to the chunks;

filling the selected one hopper with chunks until the chunks ar sensed by the first sensor for actuating the chute moving means for moving the chute to direct chunks to the other hopper; and filling the selected one hopper with liquid until the liquid is sensed by the second sensor which in response thereto actuates the hopper outlet moving means for moving the outlet of the selected one hopper to its open position for dispensing the predetermined volume of chunks/liquid mixture from the selected one hopper.

28. A method according to claim 27 wherein the outlet of the selected one hopper is moved to its open position for substantially two seconds.

29. A method according to claim 27 wherein the liquid is introduced into the hoppers in response to movement of outlet to its closed position.

30. Metering apparatus for dispensing a predetermined volume of a chunk/liquid mixture having a predetermined volumetric ratio of chunk to liquid comprising:

a hopper having a first solid wall portion for containing chunks and liquid at a first level and a second open wall portion for containing chunks but not liquid at a second level, higher than said first level;

means for introducing chunks and liquids into said hopper until said liquid reaches said first level and said chunks reach said second level, whereby a predetermined volume of a chunk/liquid mixture having a predetermined volumetric ratio of chunks to liquid is provided in said hopper;

means for discharging said mixture from said hopper; and means for adjusting the height of said solid wall portion of said hopper for controlling the ratio of chunks to liquid contained by said hopper.

* * * * *